US005115826A

United States Patent [19]

Bertsch et al.

[11] Patent Number: 5,115,826

[45] Date of Patent: May 26, 1992

[54] SPATTER SHIELD FOR DISHWASHER DOOR

[75] Inventors: Roger J. Bertsch, Lincoln Township, Berrien County; Larry D. Marks, St. Joseph Township, Berrien County, both of Mich.

[73] Assignee: Whirlpool Corporation, Benton Harbor, Mich.

[21] Appl. No.: 601,903

[22] Filed: Oct. 23, 1990

[51] Int. Cl.[5] ..... B08B 3/02

[52] U.S. Cl. ..... 134/183; 134/200; 49/476; 277/181

[58] Field of Search ..... 134/182, 183, 56 D, 134/57 D, 58 D, 181, 200; 49/476; 277/53, 181

[56] References Cited

U.S. PATENT DOCUMENTS

| | | | |
|---|---|---|---|
| 2,647,792 | 10/1950 | Flemming . | |
| 2,871,082 | 1/1959 | Karig et al. | 134/182 X |
| 3,210,144 | 10/1982 | Ullman, Jr. et al. | 134/182 X |
| 3,294,461 | 4/1965 | Barnard et al. . | |
| 3,458,241 | 10/1967 | Barnard et al. . | |
| 3,603,035 | 9/1971 | Kaldenberg . | |
| 3,903,911 | 9/1975 | Guth . | |
| 4,678,227 | 7/1987 | Castagno . | |

FOREIGN PATENT DOCUMENTS

| | | | |
|---|---|---|---|
| 2703295 | 8/1978 | Fed. Rep. of Germany | 134/183 |
| 73320 | 4/1984 | Japan | 49/476 |
| 2130082 | 5/1984 | United Kingdom | 134/56 D |
| 2198332 | 1/1988 | United Kingdom | 134/56 D |

OTHER PUBLICATIONS

A—Prints.

*Primary Examiner*—Frankie L. Stinson

*Attorney, Agent, or Firm*—Thomas J. Roth; Stephen D. Krefman; Thomas E. Turcotte

[57] ABSTRACT

A spatter shield is provided which is attached to a lower portion of the inner door of a dishwasher at a location above and inside the upper edge of the enclosure tub. This shield includes a flange area for deflecting fluid splashed toward the dishwasher opening back into the tub when the door is closed. A channel is provided which is shielded by the flange area for receiving run-off fluid from the flange area when the door is open and for discharging that run-off into the tub when the door is closed. The shield can extend horizontally along a substantial length of the door and is preferably attached to the door by way of a rib on the door which is received in a toothed slot of the shield. The teeth within the slot permit the rib to be inserted relatively easily but resist withdrawal of the rib. These teeth are preferably co-extruded with the rest of the shield from a plastic composition that is relatively flexible with respect to the material forming rest of the shield.

4 Claims, 1 Drawing Sheet

SPATTER SHIELD FOR DISHWASHER DOOR

BACKGROUND OF THE INVENTION

The present invention relates generally to automatic dishwashers and the like, and more particularly, to fluid sealing arrangements for dishwasher doors.

Automatic dishwashers have generally included an internal chamber or enclosure for retaining dishes and other articles to be washed. Cleaning fluid, such as a soap or detergent and water solution or water alone, is sprayed at the dishes and typically spatters throughout the enclosure Prior to being collected in a tub portion at the bottom of the enclosure. Cleaning fluid and any debris removed from the dishes can accumulate within the tub prior to being filtered, recirculated, and/or drained by the dishwasher pump. The door to such enclosures is usually pivotable from an open, horizontal position to a closed, vertical Position. When the door is in the closed position a resilient sealing gasket is usually disposed between the door and the enclosure opening along the top and sides of the door to prevent leakage out of the enclosure during operation.

Previous dishwashers have also employed such gaskets along the bottom of the door, although the stresses on the gaskets at those locations during opening and closing of the door may be significantly different from the gasket stresses along the sides and top of the door. In certain circumstances specially formed and/or more expensive gaskets were required in order to avoid premature wear and leakage during operation. Accordingly, previous dishwashers have also employed a lower extension of the door into the tub below the level of spraying to prevent leakage caused by spraying of the cleaning fluid. This extension may, for example, penetrate down to or below the level of accumulated fluid in the tub. Unlike the sealing gaskets, these extensions need not require compression between the door and the enclosure opening or tub in order to create an adequate seal. Sealing against spray is, in effect, accomplished in these arrangements by the tortuous or blocked path formed to the enclosure opening. Accordingly, such sealing arrangements can be more cost effective and have an increased useful life.

However, in some of those dishwashers where fluid does accumulate in significant amounts in the tub, it may be possible for surges in the accumulated fluid to cause leakage past the downward extension of the door. Even where this accumulation is below the level of spraying, surges can cause the accumulated fluid to move outward to and up the sides of the tub through an opening or gap between the tub and the downward extension of the door. As a result, spattering fluid can escape the enclosure and be deposited outside the dishwasher or on other dishwasher components.

Surges can be caused by several types of events. For example, if the dishwasher door is opened during operation the dishwasher will usually discontinue spraying, but relatively cold air is introduced to the enclosure. When the dishwasher resumes operation this cold air can be heated very quickly and tend to expand in volume. Such expansion can create a short term pressure increase within the enclosure and cause sudden movement of fluid in the tub.

Another potential source of minor leakage is termed "corner spit" or "corner congregation". During operation of dishwashers using rotating spray jets, fluid can tend to congregate in the corners of the enclosure. That fluid has a tendency to splash upwardly after falling from the enclosure sides into the tub. Where this splashing occurs at the corners of the door, fluid can also spatter behind the lower extension of the door and escape the enclosure. To the extent such leakage does occur it has been observed to be particularly prominent at the left side of the door.

At the same time, however, whatever device is employed to prevent surge or corner spit leakage must avoid depositing run-off fluid outside of the dishwasher when the door is opened in order to function most effectively. Run-off fluid from the top and sides of the door tend to remain on the enclosure side of the door and, thus, are deposited back in the tub by sliding along the lower extension of the door when the door is opened. Surge and corner spit leakage, on the other hand, are behind the inner wall of the door and, thus, cannot slide back into the tub so readily.

Accordingly, it is an object of the present invention to provide an improved sealing arrangement for automatic dishwashers.

Another object of the present invention is the provision of a cost effective, reliable seal arrangement for dishwasher doors.

A further object of the present invention is to provide a device for preventing surge spatter and corner spit leakage from penetrating a tortuous path-type fluid seal at the lower portion of a pivotable enclosure door.

SUMMARY OF THE INVENTION

These and other objects of the present invention are obtained by the provision of a spatter shield which is attached to a lower Portion of the inner door of a dishwasher at a location above and inside the upper edge of the enclosure tub. This shield includes a flange area for deflecting fluid splashed toward the dishwasher opening back into the tub when the door is closed. A channel is provided which is shielded by the flange area for receiving run-off fluid from the flange area when the door is open and for discharging that run-off into the tub when the door is closed. The shield can extend horizontally along a substantial length of the door and is preferably attached to the door by way of a rib on the door which is received in a toothed slot of the shield. The teeth within the slot permit the rib to be inserted relatively easily but resist withdrawal of the rib. These teeth are preferably co-extruded with the rest of the shield from a plastic composition that is relatively flexible with respect to the material forming the rest of the shield.

Other objects, advantages and novel features of the present invention will now become readily apparent upon consideration of this specification in light of the drawings included herewith.

DESCRIPTION OF PREFERRED EMBODIMENTS

Figure 1:
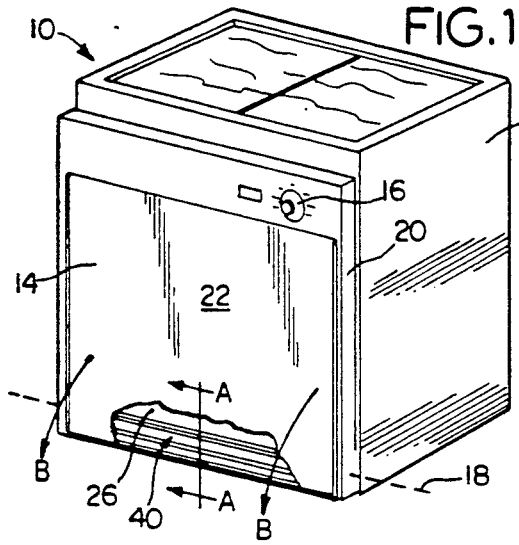
FIG. 1 shows a perspective view of a typical under counter automatic dishwasher from the front right side with a portion of the door broken away to illustrate the location of a preferred embodiment of the present invention.

FIG. 1, which illustrates use of a preferred embodiment of the present invention, shows in a general manner an under counter automatic dishwasher 10. This dishwasher forms an enclosure 12 for receiving dishes and other articles to be cleaned. Door 14 is shown covering and closing at least part of the opening to the enclosure through which those dishes and/or other articles pass. As will be readily understood by those of ordinary skill in this art, dishwasher 10 usually cleans the dishes and other articles by spraying with a solution of water and soap or detergent or the like and then rinses the dishes and other articles by spraying with water alone or in combination with a sheeting agent. For ease of understanding, the term "cleaning fluid" as used in this specification refers to any of these cleaning or rinsing fluids since, in a general sense, the present invention is responsive to the action of any such fluids in the dishwasher.

Within enclosure 12 various retaining racks are typically disposed in which the dishes and other articles are held during dishwasher operation. Impellers and jets for spraying cleaning fluid as well as portions of the pump are also typically present within enclosure 12. Particular dishwashers may have access panels below door 14 or built in countertops above door 14. Particular dishwashers may also have a different arrangement of controls on door 14 than the controls illustrated generally as element 16 in FIG. 1. None of these features, however, need to be described in particularity in order to obtain an understanding of the present invention and, thus, are omitted from FIG. 1.

As shown in FIG. 1, door 14 pivots about horizontal axis 18 between a closed vertical position (as illustrated) and open horizontal positions. The general direction of this pivotable movement is denoted by arrows B in FIG. 1. In large part, the specific door structure of dishwasher 10 is also not critical to understanding the present invention. Thus, door 14 illustrates generally dishwasher doors of the type where a tortuous or blocked path-type fluid seal against spraying of cleaning fluid is used along the lower edge of the door. In particular, door 14 includes frame 20, outer panel (usually decorative) 22 mounted within frame 20, and inner door or panel 24 attached to frame 20 either directly or through a door liner 26.

Within enclosure 12 a lower tub 28 is disposed for receiving cleaning fluid and debris from the dishes and other articles cleaned during dishwasher operation. Tub 28 is preferably formed from molded plastic and can accumulate fluid for recirculation, filtration and or discharge from dishwasher 10. Tub 28 extends upward at the opening to enclosure 12 to form edge 30 as the lower peripheral portion of that opening and the outermost portion of the fluid receiving chamber 32 defined within enclosure 12.

Inner door 24 is formed with lower extension 34 which is dimensioned to extend into tub 28 at least to the level at which cleaning fluid is sprayed upward at the dishes or other articles to be cleaned and preferably further below that level to the level where fluid has accumulated within tub 28. Extension 34 usually does not rest on tub 28 with any compressive force when door 14 is closed. In many such dishwashers a slight space 36 exists between tub 28 and the lower edge of extension 34. It is through space 36 that spatter from surges and corner spit have passed in prior dishwashers to escape from chamber 32 over edge 30.

The present invention seeks to prevent that leakage over edge 30 by including spatter shield 40 within door 14. Preferably, inner door 24 is molded with a projecting rib or flange 42 on the side of inner door 14 opposite chamber 32. Shield 40 includes a slot portion 44 for receiving rib 42 and securing shield 40 to the door. When door 14 is closed shield 40 is disposed slightly above and inside of chamber 32 with respect to edge 30, although other locations, even below edge 30, are within the scope of the present invention so long as shield 40 does not block pivotal movement of door 14 and yet does at least tend to block the path of spatter over edge 30. Further, shield 40 is preferably formed as an elongate member of substantially uniform cross-sectional configuration along its length such that shield 40 can be disposed over most of the length of edge 30 along the bottom portion of door 14, as shown in FIG. 1. It has been found to be especially advantageous in some dishwashers to mount shield 40 starting as near as possible at the left side (as viewed from FIG. 1) of inner door 24, although complete extension of shield 40 to the right side of inner door 24 is not always necessary.

Figure 2:
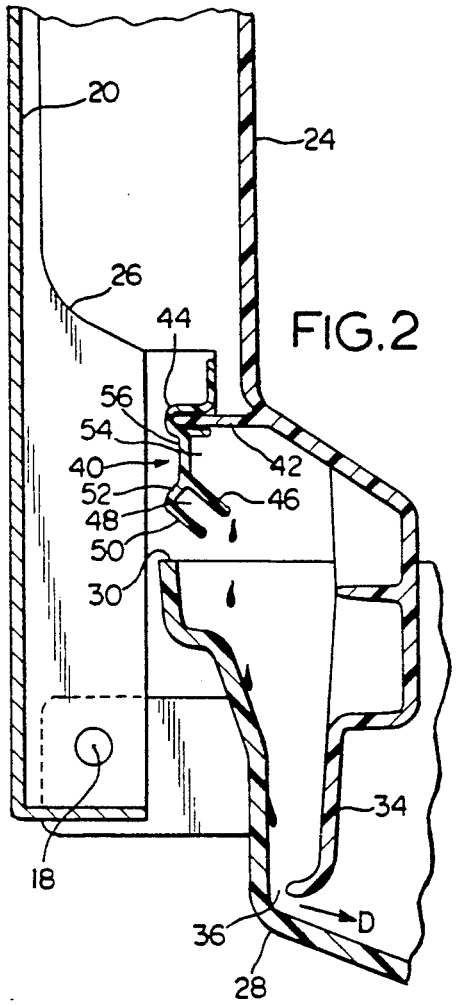
FIG. 2 shows an enlarged, partial cross-sectional view of the dishwasher of FIG. 1 as taken along line AA.
Figure 3:
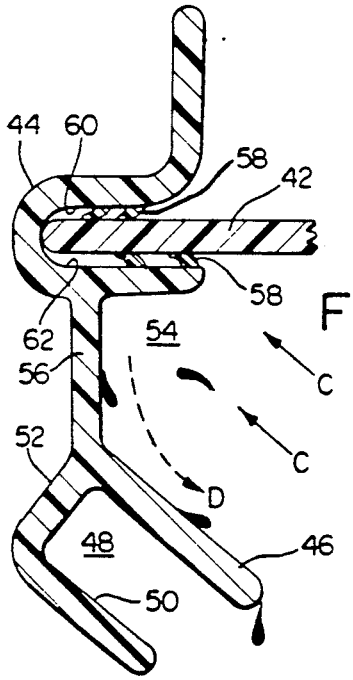
FIG. 3 shows a further enlarged, cross-sectional view of a preferred embodiment of the present invention for illustration of spatter deflection functions and attachment means as used in the dishwasher of FIG. 1.

Shield 40 serves, in effect, as another tortuous path-type fluid seal, but unlike extension 34 shield 40 is behind inner door 24 during spraying of cleaning fluid and outside of chamber 32 when door 14 is opened. Thus, special attention is given by the present invention for returning spatter to tub 28. In accomplishing this goal shield 40 employs deflecting flange 46 and channel 48 formed by lower flange 50 and bight portion 52. Spatter passing through space 36 typically has an upward and leftward movement with respect to the view of FIG. 2. Preferably, Flange 46 is spaced inwardly of flange 50 with respect to chamber 32 and is inclined downwardly toward tub 28. Further, with flange 50 also disposed below flange 46, channel 48 is effectively downstream from at least a portion of the spatter flow and at least partially shielded by flange 46 from that spatter. Thus, in preferred embodiments spatter typically strikes flange 46, rather than channel 48, and is thereby deflected downward and returned to tub 28 through space 36. FIG. 3 illustrates this general movement of spatter with arrows C denoting upward spatter movement and arrow D denoting deflected spatter movement.

Figure 4:
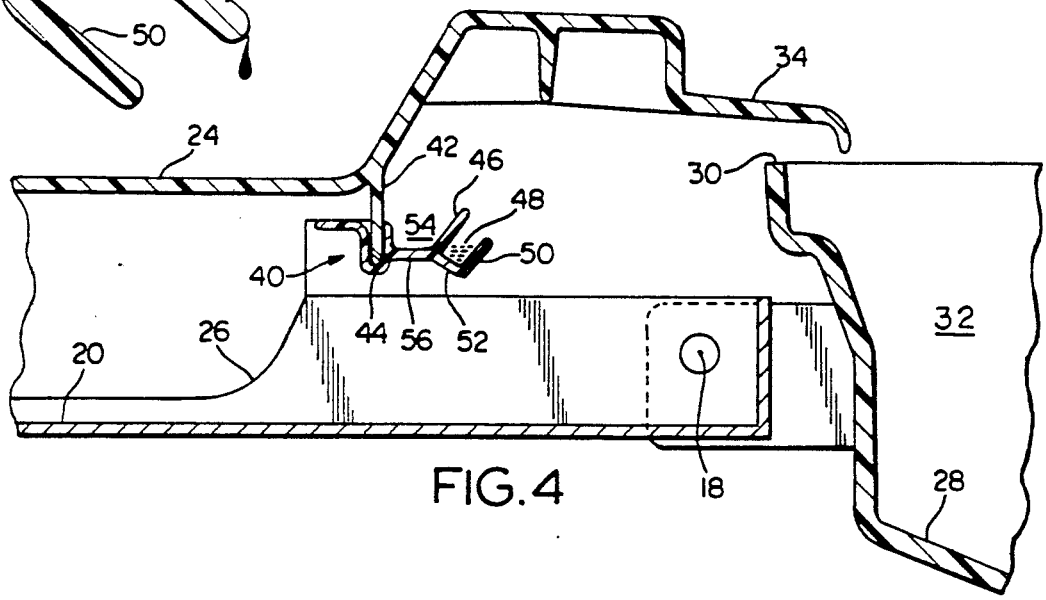
FIG. 4 shows the view of FIG. 2 when the dishwasher door is open.

To the extend any spatter strikes flange 50 when door 14 is closed that spatter will likewise be deflected back into tub 28 where, as is preferred, flange 50 is also formed with a downward incline. A principle purpose of flange 50 in preferred embodiments is to form a portion of channel 48 and permit the discharge of any fluid received or retained in that channel back into tub 28. When door 14 is closed fluid is not typically received and retained in channel 48. However, when, for example, door 14 is pivoted about axis 18 to a substantially horizontal, open position as shown in FIG. 4 then, because of the now upward incline of flanges 46 and 50, run-off fluid from flange 46 can be received and retained in channel 48, as well as channel 54 formed on the opposite side of flange 46 from channel 48 by the juncture of flange 46 and slot portion 44 across bight 56. This placement of such channels on both sides of flange 46 has been found to be especially effective in reducing run-off leakage from flange 46. Shielding of channel 48 from spatter by flange 46 when door 14 is closed has, on the other hand, been found to reduce run-off leakage from flange 50 when door 14 is open.

Further, channels 48 and 54 are preferably dimensioned so as to have sufficient depth or volume and the inclination of flanges 46 and 50 established such that run-off fluid received therein when door 14 is open does not spill out of the channels as door 14 is thereafter closed until the ends of flanges 46 and 50 are at least in vertical registration with edge 30 so that any such run-off fluid will spill into tub 28. In preferred embodiments shown in the drawings, for example, the angle of flanges 46 and 50 with respect to bight 56 is approximately 130°. At the same time, the distance between flanges 46 and 50 is approximately 4.4 mm and the depth of channel 48 is approximately 5.5 mm.

Most of shield 40 is preferably formed from a relatively rigid plastic material, such as Geon rigid PVC BFG #87438. On the other hand, rib 42 is preferably retained within slot portion 44 by means of teeth 58 formed from relatively flexible plastic material, such as Flex PVC Technor Apex #80-C167E. Teeth 58 are preferably bonded to slot portion 44 by conventional co-extrusion of the rest of shield 40, using the rigid plastic material, with teeth 58, using the flexible plastic material.

Teeth 58 are also preferably inclined (at, for example, 45°) in the direction of insertion of rib 42 such that rib 42 is more easily inserted into slot portion 44 than it is removed. Teeth 58 can be disposed on the top and bottom interior surfaces of slot portion 44, surfaces 60 and 62, respectively, so as to retain rib 42 on both of its sides. Also, slight vertical overlap in the relationship of such teeth on surfaces 60 and 62 prior to insertion of rib 42 can help ensure proper fit and retention of the rib 42 in slot portion 44 by compression against teeth 58. Thus, no additional fasteners are needed to secure shield 40 to inner door 24.

Although preferred embodiments of the present invention have been described above in detail, the same is by way of illustration and example only. For example, although not presently preferred by the applicant, shield 40 can be integrally formed with inner door 24 without exceeding the scope of the present invention. Similarly, this invention can be applied to dishwashers where cleaning fluid is applied by other forms of fluid agitation apart from spraying as well as where minimal levels of fluid accumulation in the tub is permitted and/or spraying velocities or fluid volume are increased. Also, while automatic dishwashers are the most advantageous commercial application for the present invention known at this time by the applicant it will now be recognized that the present invention can be readily used to limit leakage from other forms of fluid chambers having pivotable doors. Accordingly, the spirit and scope of this invention are limited only by the terms of the following claims.

What is claimed is:

1. An apparatus for receiving at least one article and applying fluid to said article, said apparatus having a chamber wherein said article is received, an opening to said chamber, and a door pivotably mounted with respect to said chamber such that said door normally covers said opening when said fluid is being applied to said article and is pivotable away from said opening when said fluid is not being applied to said article, said door including a shield comprising:

a first flange means for deflecting fluid splashed toward said opening when said door is covering said opening, and a channel at least partially shielded by said first flange means from said fluid splashed toward said opening, said channel being formed and located such that any fluid within said channel is discharged into said chamber when said door is covering said opening and such that at least a portion of any fluid falling from said first flange means enters said channel when said door is pivoted away from said opening, wherein said channel comprises a second flange means spaced apart from said first flange means and connected thereto by a bight portion, said second flange means being disposed beneath said first flange means and projecting into said chamber less than said first flange means when said door is covering said opening.

2. The invention according to claim 1 wherein said shield is separately formed from said door and attachable to a lower portion of said door.

3. The invention according to claim 2 wherein said lower portion of said door includes a projecting rib and said shield includes a slot means for receiving said projecting rib to attach said shield to said door.

4. The invention according to claim 3 wherein said slot means includes a plurality of flexible teeth therein for retaining said projecting rib, said teeth being disposed to permit insertion of said projecting rib into said slot means with less force than is needed to remove said projecting rib from said slot means.

* * * * *